US009945581B2

(12) United States Patent
Fujimoto et al.

(10) Patent No.: US 9,945,581 B2
(45) Date of Patent: Apr. 17, 2018

(54) WATER HEATER

(71) Applicant: NORITZ CORPORATION, Hyogo (JP)

(72) Inventors: Yu Fujimoto, Kakogawa (JP); Norihide Wada, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 119 days.

(21) Appl. No.: 14/750,983

(22) Filed: Jun. 25, 2015

(65) Prior Publication Data

US 2016/0025373 A1 Jan. 28, 2016

(30) Foreign Application Priority Data

Jul. 25, 2014 (JP) ..... 2014-151718

(51) Int. Cl.
*F22B 15/00* (2006.01)
*F23L 17/00* (2006.01)
(Continued)

(52) U.S. Cl.
CPC ..... *F24H 1/145* (2013.01); *F22B 15/00* (2013.01); *F23D 14/045* (2013.01);
(Continued)

(58) Field of Classification Search
CPC ... F24H 8/00; F24H 8/006; F24H 9/00; F24H 9/16; F24H 1/14; F24H 1/145;
(Continued)

(56) References Cited

U.S. PATENT DOCUMENTS 4,501,261 A * 2/1985 Tsutsui ..... F23N 1/082 122/14.3
5,950,573 A * 9/1999 Shellenberger ..... F23D 14/82 122/18.31

(Continued)

FOREIGN PATENT DOCUMENTS

JP S63-024347 Y2 7/1988
JP H08-000585 Y2 1/1996
JP 2000-249306 A 9/2000

OTHER PUBLICATIONS

Decision to Grant Patent; issued by the Japanese Patent Office dated Oct. 27, 2015, which corresponds to Japanese Patent Application No. 2014-151718 and is related to U.S. Appl. No. 14/750,983; with English language translation.

*Primary Examiner* — Alissa Tompkins
*Assistant Examiner* — Benjamin W Johnson
(74) *Attorney, Agent, or Firm* — Studebaker & Brackett PC

(57) ABSTRACT

A water heater includes a burner of a premixed type, a heat exchanger, and a fan suctioning combustion gas and exhausting combustion gas to the outside. The burner includes a burner case partitioned into a combustion chamber and a gas introduction chamber by a partition plate and a plurality of combustion tubes arranged in the combustion chamber. An air supply opening for supplying air into the gas introduction chamber is provided in the burner case. The partition plate has a plurality of opening portions communicating with the inside of the combustion tubes and a plurality of through holes communicating with the outside of the combustion tubes within the combustion chamber. The air supply opening is constructed to have an opening area smaller than the total sum of the total of opening areas of the plurality of opening portions and the total of opening areas of the plurality of through holes.

14 Claims, 10 Drawing Sheets

(51) Int. Cl.

| | |
|---|---|
| ***F24H 1/14*** | (2006.01) |
| ***F23L 9/00*** | (2006.01) |
| ***F23D 14/04*** | (2006.01) |
| ***F23D 14/58*** | (2006.01) |

(52) U.S. Cl.
CPC ..... *F23D 14/586* (2013.01); *F23L 9/00* (2013.01); *F24H 2210/00* (2013.01)

(58) Field of Classification Search
CPC ..... F24H 2210/00; F23L 17/005; F23L 9/00; F22B 15/00; F23D 14/045; F23D 14/586
USPC ..... 122/13.3, 18.1, 18.3, 18.31, 18.4
See application file for complete search history.

(56) References Cited

U.S. PATENT DOCUMENTS

| | | | | |
|---|---|---|---|---|
| 7,597,066 | B2 * | 10/2009 | Shimada | F23N 1/082 122/14.22 |
| 8,267,051 | B2 * | 9/2012 | Ando | F23N 3/065 122/14.31 |
| 2004/0039354 | A1 * | 2/2004 | Lutz, II | G05D 23/1393 604/291 |
| 2013/0149653 | A1 * | 6/2013 | Fukunishi | F23D 14/02 431/278 |

* cited by examiner

WATER HEATER

BACKGROUND OF THE INVENTION

Field of the Invention

The present invention relates to a water heater, and particularly to a water heater of an exhaust suction type which suctions and exhausts combustion gas to the outside of the water heater.

Description of the Background Art

It has been known that oscillating combustion occurs depending on a combustion condition in a burner having a large number of burner ports. Namely, when flame is disturbed by disturbance of a flow velocity (an amount per unit time of injection from burner ports) of an air fuel mixture, an amount per unit time of heat generation (a rate of heat generation) by flame fluctuates. When a cycle of fluctuation in pressure caused by this fluctuation coincides with a natural frequency of a burner, this frequency is excited and oscillating combustion occurs. When oscillating combustion occurs, a combustion state becomes unstable and noise may be generated due to oscillation of the burner.

A burner capable of achieving low-NOx combustion and high-load combustion has recently been demanded with reduction in size of the burner. It has been known, however, that oscillating combustion is likely particularly in such a burner (see, for example, Japanese Patent Laid-Open No. 2000-249306).

It has conventionally empirically been known that oscillating combustion is likely to occur when burner ports are equal in size (cross-sectional area). Therefore, for example, measures for suppression of oscillating combustion based on an effect of interference between flames by making sizes of burner ports of combustion tubes non-uniform have been taken. A mechanism of occurrence of oscillating combustion, however, has not sufficiently been clarified. Actually, measures for suppression of oscillating combustion are taken for each individual burner through trial and error by experientially changing a combustion condition, a shape of a burner and the like.

As disclosed in Japanese Utility Model Publication No. 63-24347 and Japanese Utility Model Publication No. 8-585, on the other hand, a water heater of an exhaust suction type having air blow means on a downstream side of an exhaust flow path of a burner in order to suction and exhaust combustion gas to the outside of the water heater has been known.

Conventionally, there has been insufficient discussion of measures for suppression of oscillating combustion when a burner is reduced in size and when low-NOx combustion and high-load combustion are desired in a water heater of an exhaust suction type.

Measures for suppression of oscillating combustion have been discussed for a water heater of a forced exhaust type in which combustion gas is exhausted to the outside as a fan forces outside air into the inside. The present inventors have found, however, that measures similar to those for the water heater of the forced exhaust type alone cannot necessarily sufficiently suppress oscillating combustion in a water heater of an exhaust suction type particularly when a burner is reduced in size and low-NOx combustion and high-load combustion are desired.

SUMMARY OF THE INVENTION

The present invention was made in view of the above-described problems, and an object thereof is to provide a water heater of an exhaust suction type capable of more reliably achieving suppression of occurrence of oscillating combustion of a burner.

A water heater according to the present invention includes a burner of a premixed type which generates combustion gas by burning an air fuel mixture in a combustion region, a heat exchanger heating water which flows through the inside, through heat exchange with combustion gas generated in the burner, and a fan suctioning combustion gas which has passed through the heat exchanger and exhausting combustion gas to the outside. The burner includes a burner case partitioned into a combustion chamber and a gas introduction chamber by a partition plate and a plurality of combustion tubes arranged in the combustion chamber. The burner case is provided with an air supply opening for supplying air into the gas introduction chamber. The partition plate has a plurality of opening portions communicating with the inside of the combustion tubes and a plurality of through holes communicating with the outside of the combustion tubes within the combustion chamber.

The water heater according to the present invention is constructed such that the air supply opening has an opening area smaller than a total sum of a total of opening areas of the plurality of opening portions and a total of opening areas of the plurality of through holes. According to such a construction, fluctuation in pressure in the burner case can be suppressed by providing an air flow resistance on an upstream side of the burner. Therefore, a water heater of an exhaust suction type capable of more reliably achieving suppression of occurrence of oscillating combustion of the burner can be provided.

In the water heater according to the present invention, the air supply opening preferably has a plurality of air supply opening portions. Thus, in an environment where fluffy dust or sandy dust is present, dust suctioned into the burner is distributed as compared with a case that a single air supply opening portion is provided, and hence local clogging in a combustion tube located directly above the air supply opening portion can be suppressed.

Preferably, the combustion region is constituted of a plurality of unit regions which can independently be controlled such that an amount of generation of combustion gas can be varied in accordance with requested hot water supply capability, and the air supply opening is arranged at a position other than a portion directly under at least one of the plurality of unit regions which is always combusted in a combustion state of the burner. Thus, an air flow resistance against a flow of air supplied into the always combusted unit region can be higher and fluctuation in pressure in the burner case can more efficiently be suppressed. In addition, since clogging by dust of a combustion tube located in the most important unit region always combusted in a combustion state can be suppressed, the combustion state in the combustion region can be stabilized.

Preferably, a protruding portion protruding outward is provided in a part of a periphery of the air supply opening of the burner case and no protruding portion is provided in other part of the periphery of the air supply opening. Thus, even though a piece of paper which is larger than the opening area of the air supply opening may stick to the air supply opening, a path for air between outside air and the gas introduction chamber can be ensured in a portion where no protruding portion is provided or a portion other than a tip end of the protruding portion, and the air supply opening can be prevented from being closed.

Preferably, the air supply opening is in a rectangular shape and the protruding portion is formed by folding back a part of the burner case outward in a portion corresponding to at least one side of the rectangular shape. Since the air supply opening portion is in a rectangular shape, the protruding portion can readily be formed by folding back a part of the burner case which has been burred outward in advance (burring process) in the portion corresponding to at least one side of the rectangular shape.

Preferably, the protruding portion has a hole portion. Thus, a path for air between outside air and a gas introduction chamber through the hole portion can more reliably be ensured and the air supply opening can more reliably be prevented from being closed.

Preferably, the burner is of a rich and lean combustion type. Since oscillating combustion is particularly likely in this case, measures for suppression of oscillating combustion according to the present invention are effective.

According to the present invention, a water heater of an exhaust suction type capable of more reliably achieving suppression of occurrence of oscillating combustion of a burner can be provided.

DESCRIPTION OF THE PREFERRED EMBODIMENTS

Figure 1:
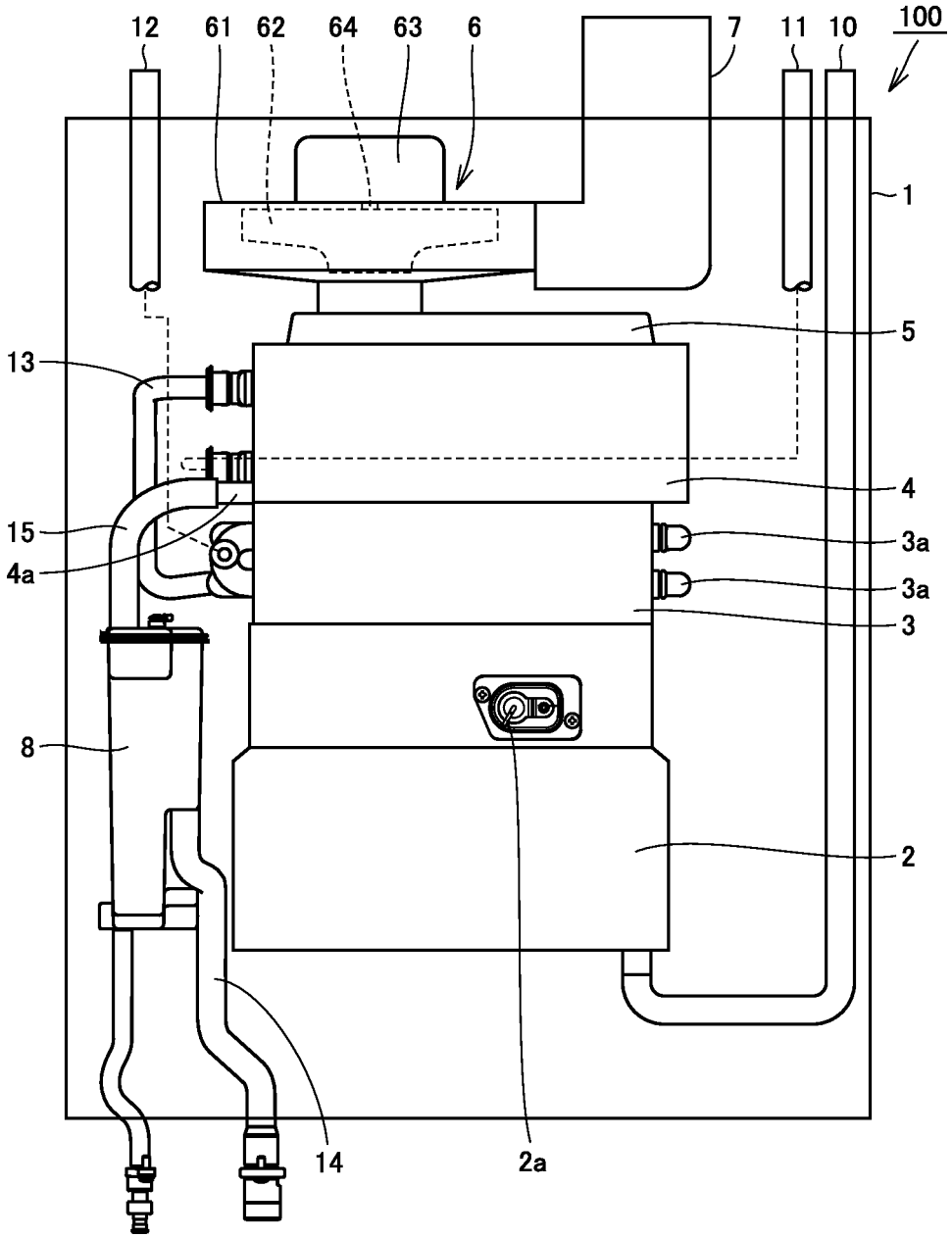
FIG. 1 is a front view schematically showing a construction of a water heater in a first embodiment.

An embodiment of the present invention will be described hereinafter with reference to drawings. In the drawings, the same or corresponding elements have the same reference characters allotted. Relation of such a dimension as a length, a width, a thickness, or a depth is modified as appropriate for clarity and brevity of the drawings and does not represent actual dimensional relation.

First Embodiment

Figure 2:
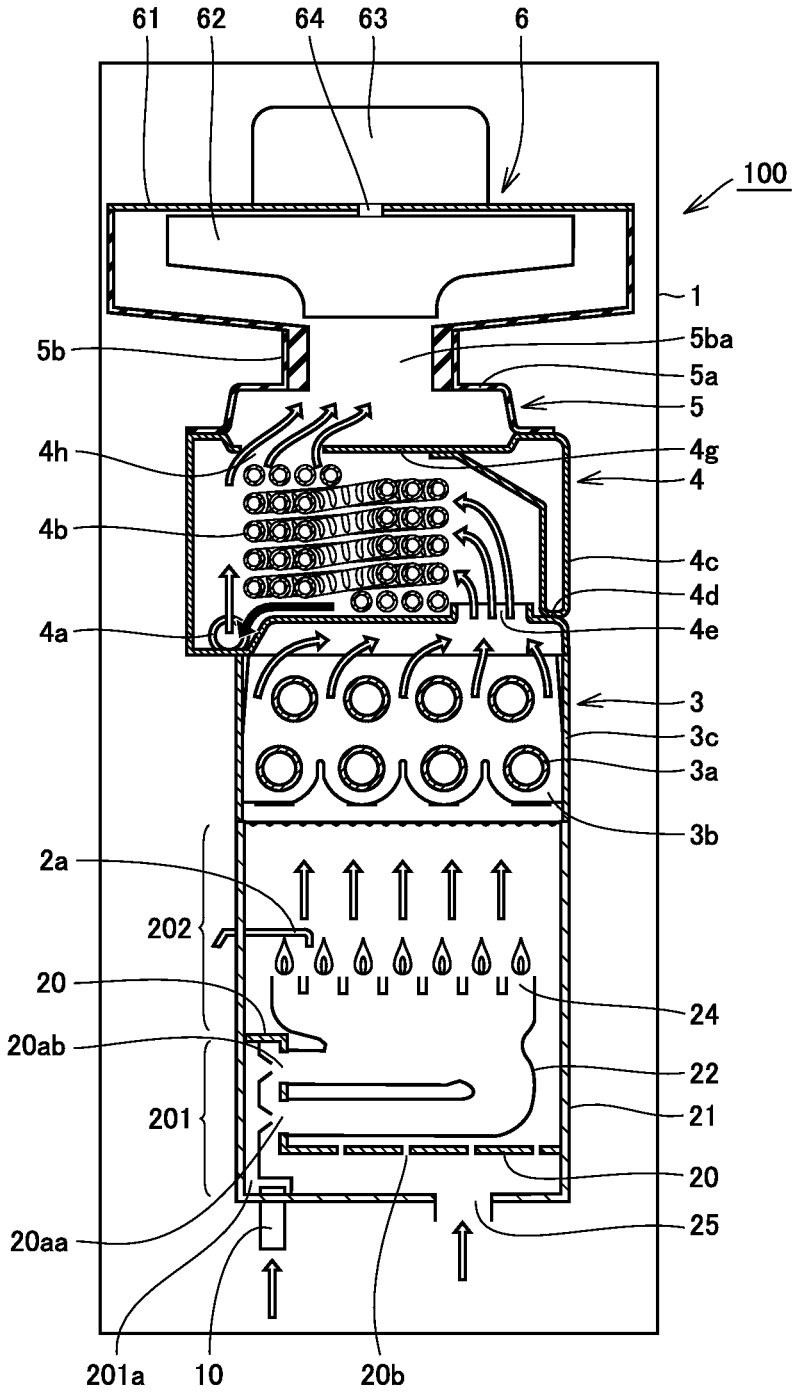
FIG. 2 is a partial cross-sectional side view schematically showing the construction of the water heater shown in FIG. 1.

Referring mainly to FIGS. 1 and 2, a water heater 100 in the present embodiment mainly has a housing 1, a burner 2, a primary heat exchanger 3, a secondary heat exchanger 4, an exhaust box 5, a fan 6, an exhaust tube 7, a drainage water tank 8, and pipes 10 to 15. Since water heater 100 in the present embodiment is of an exhaust suction and combustion type, burner 2, primary heat exchanger 3, secondary heat exchanger 4, and fan 6 are arranged in this order from an upstream side to a downstream side in a flow of combustion gas.

(Burner)

Figure 3:
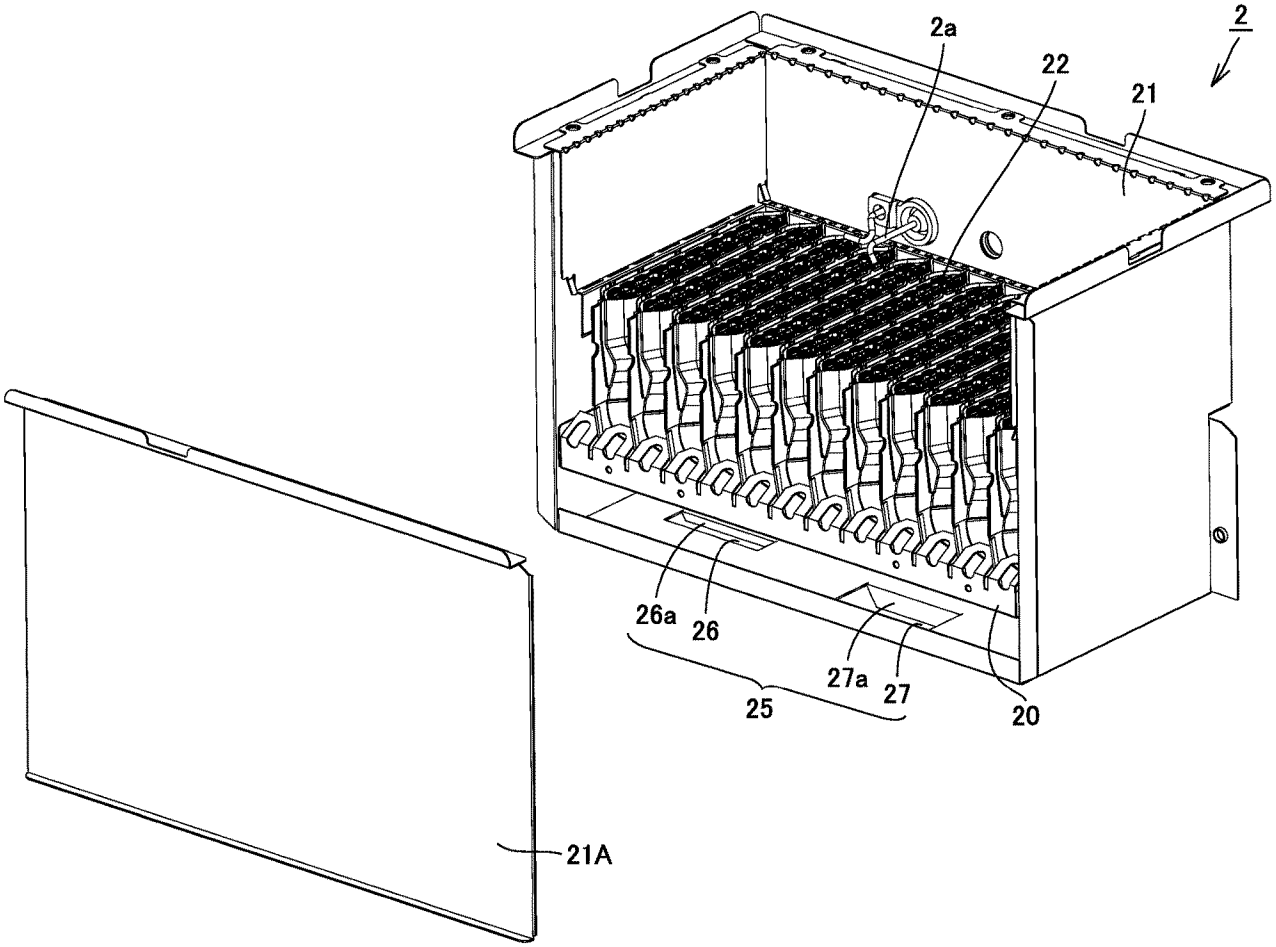
FIG. 3 is a perspective view schematically showing a construction of a burner in the water heater in the first embodiment and an exploded perspective view with a wall surface 21A of a burner case being removed.

Referring mainly to FIGS. 2 and 3, burner 2 includes a burner case 21 partitioned into a combustion chamber 202 and a gas introduction chamber 201 by a partition plate 20 and a plurality of combustion tubes 22 having a plurality of burner port portions 24 arranged in combustion chamber 202. An air supply opening 25 for supplying air into gas introduction chamber 201 is provided in a bottom plate of burner case 21.

A gas supply pipe 10 is connected to a fuel gas introduction chamber 201*a* which is a part of gas introduction chamber 201. A main electromagnetic valve 10*a*, a proportional valve 10*b*, and a plurality of electromagnetic valves 10*c* are attached to gas supply pipe 10 (see FIG. 5).

Figure 4:
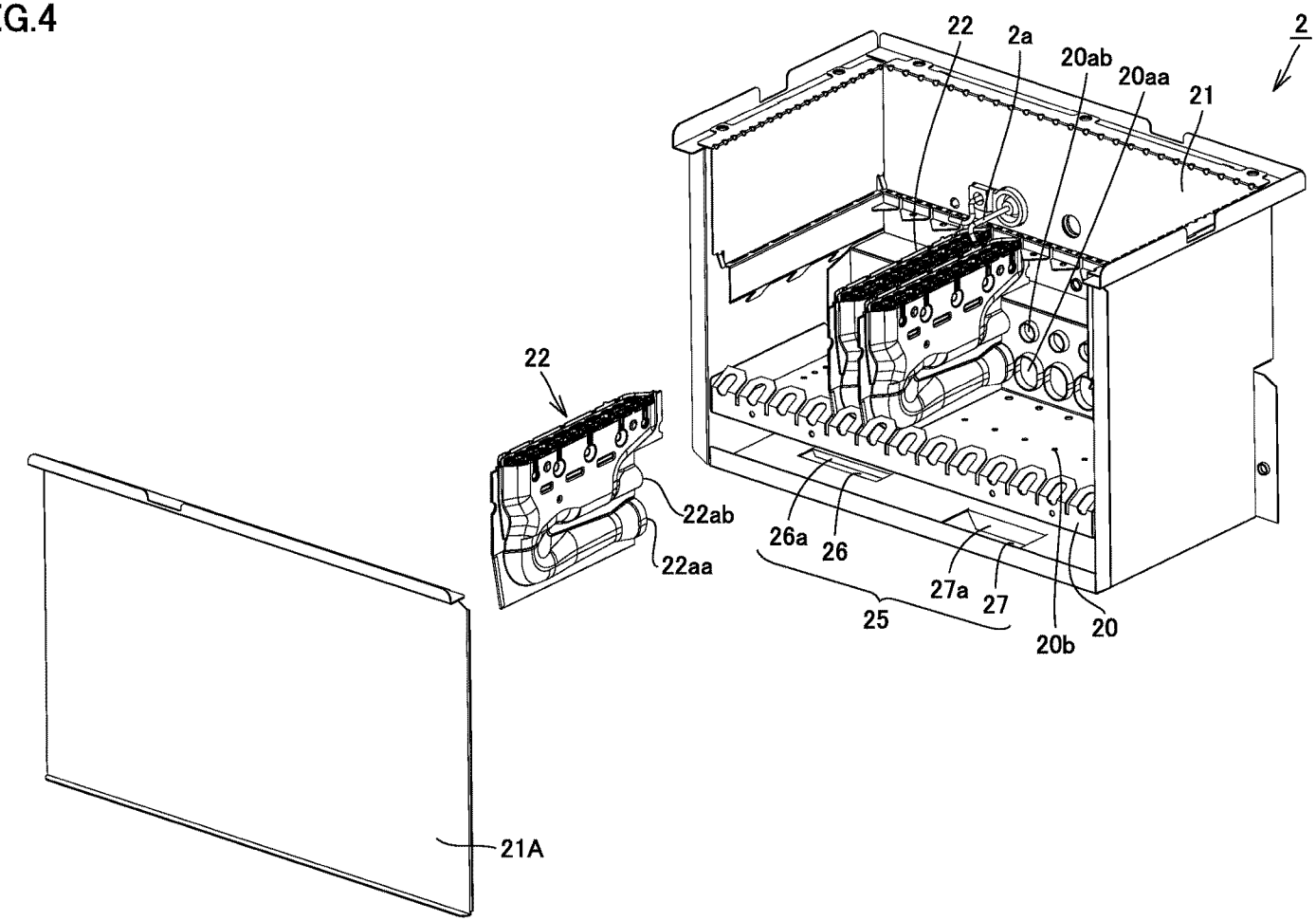
FIG. 4 is an exploded perspective view of the burner with some combustion tubes being further removed from the exploded perspective view in FIG. 3.
Figure 7:
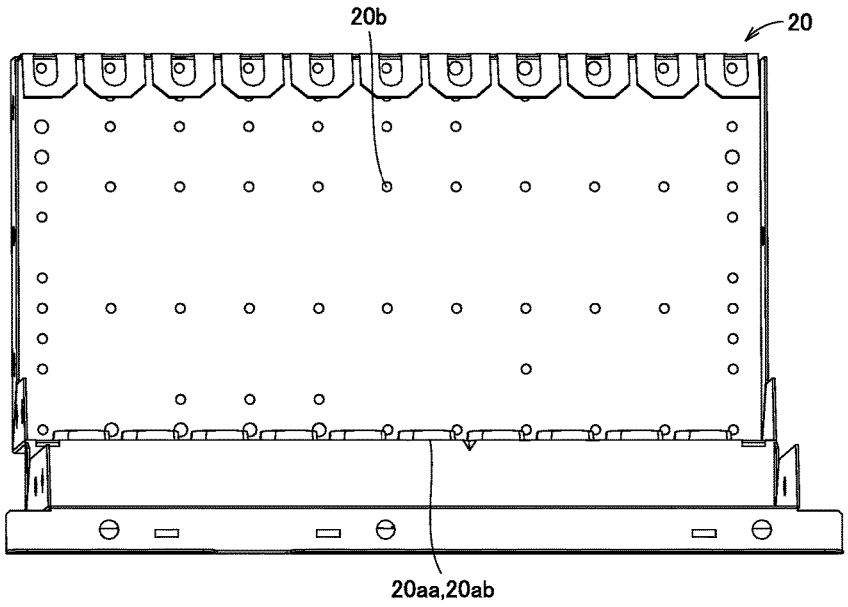
FIG. 7 is a top view schematically showing a construction of a partition plate of the burner case in the water heater in the first embodiment.

Referring mainly to FIGS. 2 and 4, partition plate 20 has a plurality of opening portions 20*aa* and 20*ab* communicating with the inside of combustion tubes 22 and a plurality of through holes 20*b* communicating with the outside of combustion tubes 22 within combustion chamber 202 (see FIG. 7). Thus, gas introduction chamber 201 communicates with the inside of combustion tubes 22 and the outside of combustion tubes 22 within combustion chamber 202.

Some of air supplied into gas introduction chamber 201 through air supply opening 25 (air supply opening portions 26 and 27) is mixed as primary air with fuel gas supplied into fuel gas introduction chamber 201*a* through gas supply pipe 10 to form an air fuel mixture, and this air fuel mixture is supplied into combustion tubes 22 through gas inlets 22*aa* and 22*ab* of the plurality of combustion tubes 22 through the plurality of opening portions 20*aa* and 20*ab* provided in partition plate 20. Thus, burner 2 is of a premixed type in which combustion gas is generated by burning an air fuel mixture obtained by mixing in advance.

The rest of air supplied into gas introduction chamber 201 through air supply opening 25 is supplied as secondary air to the outside of combustion tubes 22 within combustion chamber 202 while it is rectified, through the plurality of through holes 20*b* provided in partition plate 20.

Referring mainly to FIGS. 3 and 4, each of the plurality of combustion tubes 22 is stored in combustion chamber 202 of burner case 21 as being supported by partition plate 20. Gas inlets 22*aa* and 22*ab* (see FIG. 12) in each of the plurality of combustion tubes 22 are connected to respective openings 20*aa* and 20*ab* provided in a wall surface of partition plate 20.

Figure 5:
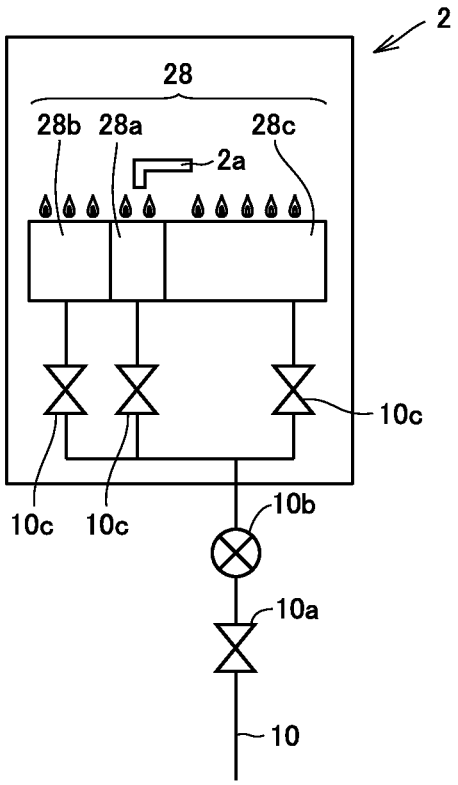
FIG. 5 is a schematic cross-sectional view schematically showing a construction of the burner in the water heater in the first embodiment.

Referring mainly to FIG. 5, in the water heater in the present embodiment, air is sent to a combustion region 28 including the plurality of combustion tubes 22 (not shown) with the number of rotations of fan 6 being increased, and fuel gas is supplied thereto by opening main electromagnetic valve 10*a*, proportional valve 10*b*, and the plurality of electromagnetic valves 10*c* provided in gas supply pipe 10. Thus, the air fuel mixture can be supplied into combustion tubes 22. Proportional valve 10*b* allows continuous adjustment of an amount of gas supplied into combustion tubes 22 within a range of a rated amount. Main electromagnetic valve 10*a* can allow supply and stop of fuel gas to burner 2. Flame produced in burner 2 can be extinguished by stopping supply of fuel gas by closing main electromagnetic valve 10*a*, proportional valve 10*b*, and the plurality of electromagnetic valves 10*c*.

Here, combustion region 28 including the plurality of combustion tubes 22 is constituted of a plurality of unit regions 28*a*, 28*b*, and 28*c* which can independently be controlled so as to allow variation in amount of generation of combustion gas in accordance with requested hot water supply capability. Specifically, two combustion tubes 22 (see FIG. 4) are arranged in unit region 28*a*, three combustion tubes 22 are arranged in unit region 28*b*, and five combustion tubes 22 are arranged in unit region 28*c*. The plurality of electromagnetic valves 10*c* are connected to unit regions 28*a*, 28*b*, and 28*c*, respectively. By thus independently controlling a state of opening and closing of the plurality of electromagnetic valves 10*c* provided for respective unit regions, the number of combustion tubes 22 to be used for combustion (the number of steps of the water heater) can be adjusted and combustion capability of the burner can be adjusted. Unit region 28*a* where two combustion tubes 22 are arranged is always combusted in a state of combustion of burner 2.

Referring mainly to FIGS. 2 to 5, a spark plug 2*a* is arranged above combustion tubes 22 (unit region 28*a* where two combustion tubes 22 are arranged). This spark plug 2*a* serves to ignite an air fuel mixture injected from burner port portion 24 of combustion tube 22 by generating sparks between the plug and a target (not shown) provided in combustion tube 22, as an ignition apparatus (an igniter) is activated. Burner 2 generates a quantity of heat by thus burning the air fuel mixture (which is called a combustion operation).

In the water heater in the present embodiment, burner 2 is of a rich and lean combustion type. A burner of a rich and lean combustion type is characterized in that an air fuel mixture (a lean gas) of which ratio of air to fuel is higher than 1 is burnt in a lean burner port for achieving lower NOx, while an air fuel mixture (a rich gas) of which ratio of air to fuel is lower than 1 is burnt in a rich burner port adjacent to the lean burner port. A construction of the combustion tube included in the burner of the rich and lean combustion type in the present embodiment will be described.

Figure 12:
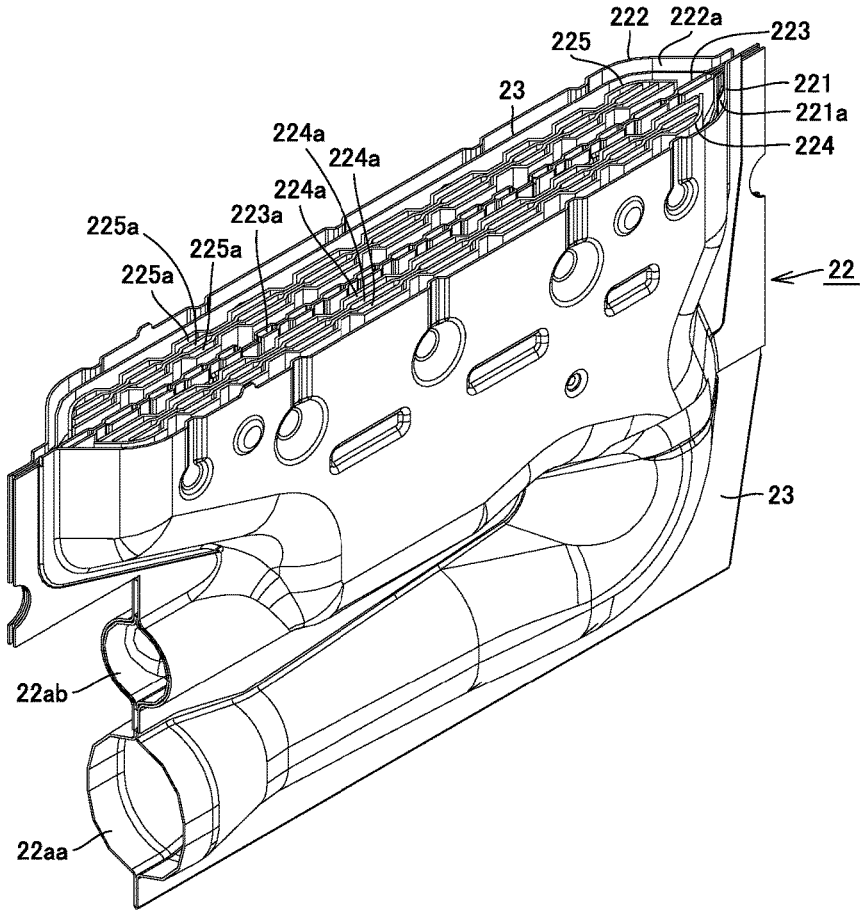
FIG. 12 is a perspective view schematically showing a construction of the combustion tube in the water heater in the first embodiment.

Referring mainly to FIG. 12, combustion tube 22 mainly has a main body unit 23, a pair of left and right side rich-gas units 221 and 222, a central rich-gas unit 223, and a pair of left and right lean-gas units 224 and 225. Main body unit 23 is provided with gas inlet 22*aa* for lean gas and gas inlet 22*ab* for rich gas.

Some of rich gas supplied through gas inlet 22*ab* for rich gas passes through a hole provided in a sidewall of main body unit 23 and is injected through end rich burner port portions 221*a* and 222*a* between an outer wall of main body unit 23 and an inner wall of each of side rich-gas units 221 and 222. Rich gas other than this passes through a rich-gas passage within main body unit 23 and is injected from a rich burner port portion 223*a* of central rich-gas unit 223. Lean gas supplied through gas inlet 22*aa* for lean gas passes through a lean-gas passage within main body unit 23 and is injected from lean burner port portions 224*a* and 225*a* of a pair of lean-gas units 224 and 225.

Figure 6:
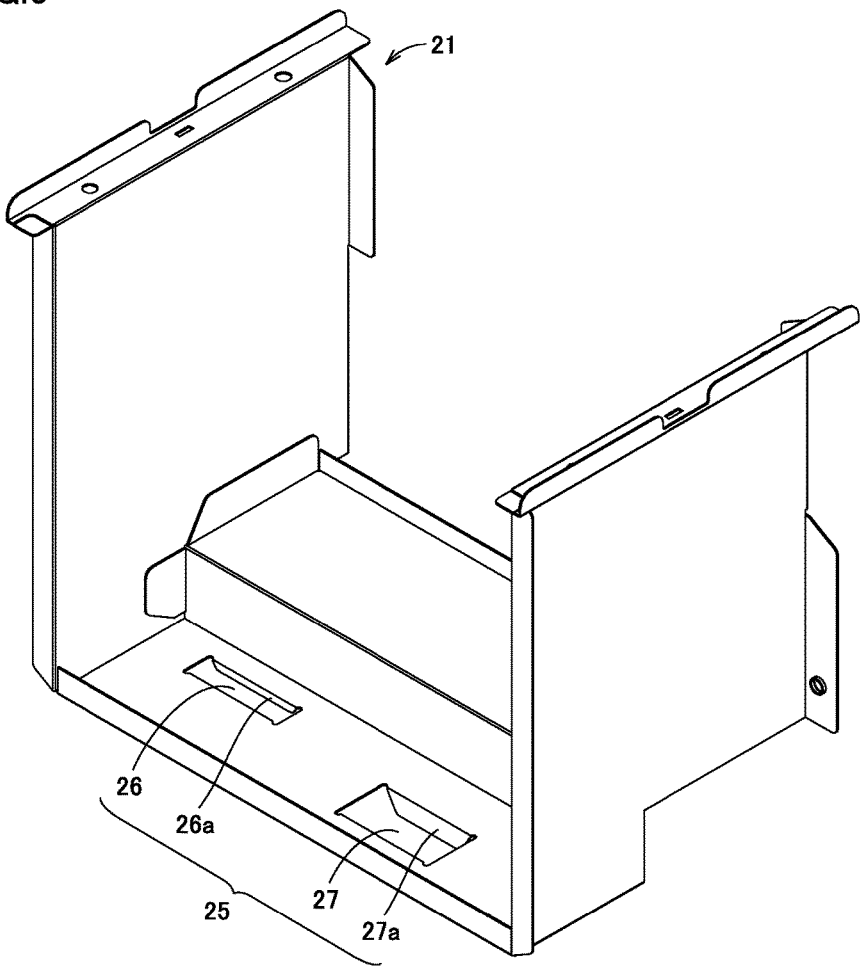
FIG. 6 is a perspective view schematically showing a construction of the burner case in the water heater in the first embodiment.
Figure 8:
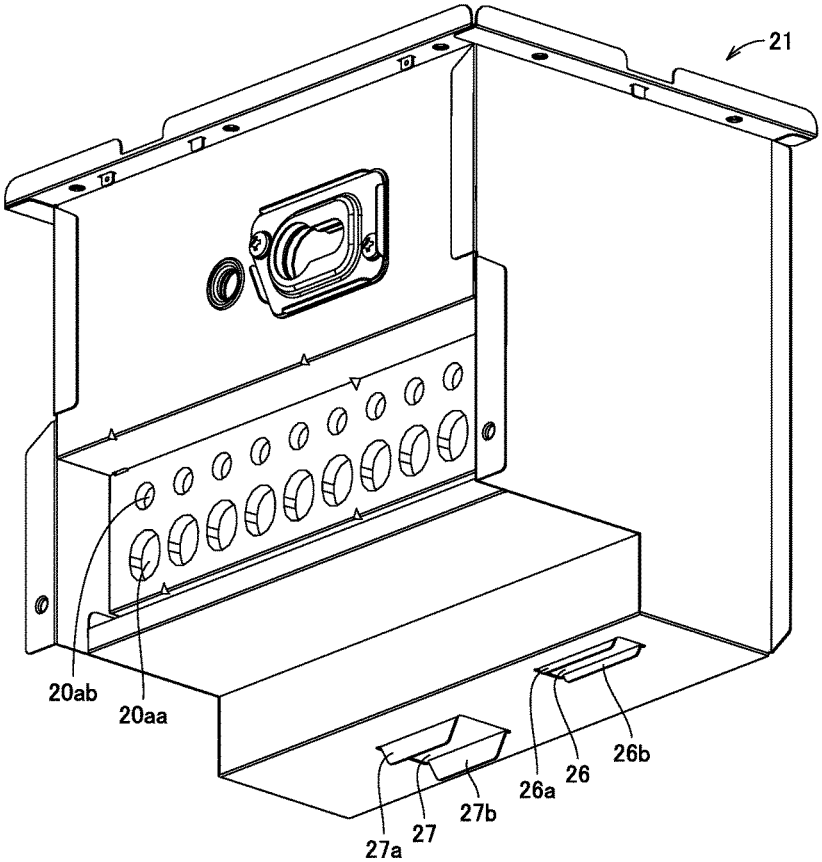
FIG. 8 is a schematic perspective view of the burner case shown in FIG. 4 when viewed from another angle.

Referring mainly to FIGS. 6 and 8, in the water heater in the present embodiment, air supply opening 25 in the bottom plate of burner case 21 is constituted of two air supply opening portions 26 and 27. An opening area of air supply opening 25 (a total of an opening area of air supply opening portion 26 and an opening area of air supply opening portion 27) is smaller than the total sum of the total of opening areas of the plurality of opening portions 20*aa* and 20*ab* provided in the wall surface of partition plate 20 and the total of opening areas of the plurality of through holes 20*b* provided in the bottom surface of partition plate 20 (see also FIGS. 2, 4, and 7). Referring mainly to FIG. 2, in gas introduction chamber 201, the total of opening areas on the upstream side in a flow of gas (the outside of burner 2) is smaller than the total sum of opening areas on the downstream side in the flow of gas (on a side of combustion chamber 202).

Air supply opening portions 26 and 27 are arranged at positions other than a portion directly under unit region 28*a* including two combustion tubes 22 (two combustion tubes 22 stored in burner case 21 shown in FIG. 4) which is always combusted in the state of combustion of burner 2, of the plurality of unit regions 28*a*, 28*b*, and 28*c* (see FIG. 5) constituting combustion region 28.

Air supply opening portion 26 is arranged directly under unit region 28*b* (FIG. 5) including three combustion tubes 22, and air supply opening portion 27 is arranged directly under unit region 28*c* (FIG. 5) including five combustion tubes 22. Therefore, the opening area of air supply opening portion 27 is designed to be greater than the opening area of air supply opening portion 26 such that air in accordance with combustion capability (the number of combustion tubes 22) in unit region 28*b* and unit region 28*c* can be supplied.

Referring mainly to FIGS. 6 and 8, in the water heater in the present embodiment, protruding portions 26*a*, 26*b*, 27*a*, and 27*b* protruding outward are provided in a part of a periphery of air supply opening 25 (air supply opening portions 26 and 27) in the bottom plate of burner case 21, and no protruding portion is provided in other portions of the periphery of air supply opening 25. Specifically, the protruding portions shown in FIG. 8 are such that protruding portions 26*a*, 26*b*, 27*a*, and 27*b* are provided in long sides of rectangular air supply opening portions 26 and 27 and no protruding portion is provided in a short side.

(Primary Heat Exchanger)

Referring mainly to FIG. 2, primary heat exchanger 3 is a heat exchanger of a sensible heat recovery type. This primary heat exchanger 3 mainly has a plurality of plate-shaped fins 3*b*, a heat conduction pipe 3*a* penetrating the plurality of plate-shaped fins 3*b*, and a case 3*c* accommodating fins 3*b* and heat conduction pipe 3*a*. Primary heat exchanger 3 exchanges heat with combustion gas generated by burner 2, and specifically, serves to heat water which flows through heat conduction pipe 3*a* of primary heat exchanger 3 with the quantity of heat generated as a result of the combustion operation of burner 2.

(Secondary Heat Exchanger)

Referring mainly to FIG. 2, secondary heat exchanger 4 is a heat exchanger of a latent heat recovery type. This secondary heat exchanger 4 is located downstream of primary heat exchanger 3 in a flow of combustion gas and connected in series with primary heat exchanger 3. Since water heater 100 according to the present embodiment thus has secondary heat exchanger 4 of a latent heat recovery type, it is a water heater of the latent heat recovery type.

Thus, the water heater in the present embodiment is of a latent heat recovery type which includes a secondary heat exchanger recovering mainly latent heat in addition to the primary heat exchanger recovering mainly sensible heat of combustion gas, and can obtain heat of condensation (latent heat) by condensing vapor contained in combustion gas and can achieve high heat exchange efficiency. The water heater according to the present invention is not limited to the water heater of the latent heat recovery type, and a water heater other than the latent heat recovery type may be applicable.

Secondary heat exchanger 4 mainly has a drainage water discharge port 4*a*, a heat conduction pipes 4*b*, a sidewall 4*c*, a bottom wall 4*d*, and an upper wall 4*g*. Heat conduction pipes 4*b* is layered as it is helically wound. Sidewall 4*c*, bottom wall 4*d*, and upper wall 4*g* are arranged to surround heat conduction pipes 4*b*.

In secondary heat exchanger 4, water flowing through heat conduction pipes 4*b* is pre-heated (heated) through heat exchange with combustion gas of which heat has been exchanged in primary heat exchanger 3. As a temperature of combustion gas is lowered to approximately 60° C. through this process, moisture contained in combustion gas is condensed so that latent heat can be obtained. In addition, latent heat is recovered in secondary heat exchanger 4 and moisture contained in combustion gas is condensed, thereby producing drainage water.

Bottom wall 4*d* serves as a partition between primary heat exchanger 3 and secondary heat exchanger 4, and also serves as an upper wall of primary heat exchanger 3. This bottom wall 4*d* is provided with an opening 4*e* that allows communication between a space where heat conduction pipe 3*a* of primary heat exchanger 3 is arranged and a space where heat conduction pipes 4*b* of secondary heat exchanger 4 is arranged.

As shown with hollow arrows in FIG. 2, combustion gas can flow from primary heat exchanger 3 to secondary heat exchanger 4 through opening 4*e*. In this embodiment, for the sake of simplification, although one common component is employed for bottom wall 4*d* of secondary heat exchanger 4 and the upper wall of primary heat exchanger 3, an exhaust collection and guide member may be connected between primary heat exchanger 3 and secondary heat exchanger 4.

Upper wall 4*g* is provided with an opening 4*h*. This opening 4*h* allows communication between the space where heat conduction pipes 4*b* of secondary heat exchanger 4 is arranged and an internal space in exhaust box 5. As shown with hollow arrows in FIG. 2, combustion gas can flow from secondary heat exchanger 4 into the internal space in exhaust box 5 through opening 4*h*.

Drainage water discharge port 4*a* is provided in sidewall 4*c* or bottom wall 4*d*. This drainage water discharge port 4*a* opens at a lowest position in the space surrounded by sidewall 4*c*, bottom wall 4*d* and upper wall 4*g* (at a lowermost position in a vertical direction in the state where the water heater is placed), which is lower than the lowermost end of heat conduction pipes 4*b*. Thus, drainage water produced in secondary heat exchanger 4 can be guided to drainage water discharge port 4*a* along bottom wall 4*d* and sidewall 4*c* as shown with black arrows in FIG. 2.

(Exhaust Box)

Referring mainly to FIG. 2, exhaust box 5 forms a path for a flow of combustion gas between secondary heat exchanger 4 and fan 6. This exhaust box 5 can guide combustion gas of which heat has been exchanged in secondary heat exchanger 4 to fan 6. Exhaust box 5 is attached to secondary heat exchanger 4 and located downstream of secondary heat exchanger 4 in the flow of combustion gas.

Exhaust box 5 mainly has a box main body 5*a* and a fan connection portion 5*b*. An internal space of box main body 5*a* communicates through opening 4*h* of secondary heat exchanger 4 with the internal space in which heat conduction pipes 4*b* of secondary heat exchanger 4 is arranged. Fan connection portion 5*b* is provided so as to protrude from the upper portion of box main body 5*a*. This fan connection portion 5*b* has a cylindrical shape, for example, and has an internal space 5*ba* that communicates with the internal space of box main body 5*a*.

(Fan)

Referring mainly to FIGS. 1 and 2, fan 6 mainly has a fan case 61, an impeller 62, a drive source 63, and a rotation shaft 64. Drive source 63 is provided outside fan case 61 and rotation shaft 64 couples impeller 62 accommodated in fan case 61 and drive source 63 provided outside fan case 61 to each other. Thus, impeller 62 can rotate around rotation shaft 64 as it receives drive force from drive source 63.

Fan 6 is arranged downstream of the heat exchanger (the primary heat exchanger and the secondary heat exchanger) in the direction of flow of combustion gas and constructed to pull air into burner 2. Fan 6 is connected to exhaust tube 7 located outside water heater 100 in order to suction combustion gas which has passed through secondary heat exchanger 4 (of which heat has been exchanged in secondary heat exchanger 4) and to emit combustion gas to the outside of water heater 100. Exhaust tube 7 is arranged outside water heater 100 and connected on an outer circumferential side of fan case 61. Therefore, combustion gas emitted to the outer circumferential side of impeller 62 can be emitted out of water heater 100 through exhaust tube 7.

Fan 6 is thus located downstream of exhaust box 5 and secondary heat exchanger 4 in the flow of combustion gas. Namely, in water heater 100, burner 2, primary heat exchanger 3, secondary heat exchanger 4, exhaust box 5, and fan 6 are arranged in this order from upstream to downstream in the flow of combustion gas produced in burner 2. Since combustion gas is suctioned and exhausted by means of fan 6 as above in this arrangement, water heater 100 in the present embodiment is a water heater of an exhaust suction and combustion type.

(Drainage Water Tank)

In the water heater of the latent heat recovery type, drainage water (condensate) resulting from condensation of vapor in combustion gas within the secondary heat exchanger is generated. Here, combustion gas contains a nitrogen oxide generated as a result of reaction between nitrogen and oxygen in air caused by combustion or a sulfur oxide generated as a result of reaction between a sulfur component in fuel and oxygen caused by combustion. Since drainage water thus generated in the secondary heat exchanger exhibits strong acidity owing to such a nitrogen oxide or sulfur oxide, normally, it is discharged to the outside after it is neutralized by a neutralizer disposed in the drainage water tank.

Referring mainly to FIGS. 1 and 2, in order to discharge drainage water in secondary heat exchanger 4 to the outside in the water heater in the present embodiment, drainage water tank 8 and drainage water discharge port 4*a* of secondary heat exchanger 4 are connected by pipe 15. Drainage water discharge piping 14 is connected to drainage water tank 8 and leads to the outside of water heater 100. Acid drainage water stored in drainage water tank 8 is temporarily stored in the internal space of drainage water tank 8, and thereafter usually discharged through drainage water discharge piping 14 to the outside of water heater 100.

(Pipe)

Referring mainly to FIGS. 1 and 2, a water supply pipe 11 is connected to one end of heat conduction pipes 4*b* of secondary heat exchanger 4 and a hot water delivery pipe 12 is connected to one end of heat conduction pipe 3*a* of primary heat exchanger 3. The other end of heat conduction pipe 3*a* of primary heat exchanger 3 and the other end of heat conduction pipes 4*b* of secondary heat exchanger 4 are connected to each other through a connection pipe 13. Each of gas supply pipe 10, water supply pipe 11, and hot water delivery pipe 12 leads to the outside, for example, in a top portion of water heater 100. Burner 2, primary heat exchanger 3, secondary heat exchanger 4, exhaust box 5, fan 6, and drainage water tank 8 are arranged in housing 1.

Functions and effects of the water heater in the present embodiment will now be described. Initially, in the water heater in the present embodiment, the opening area of air supply opening 25 (the total of the opening area of air supply opening portion 26 and the opening area of air supply opening portion 27) in the bottom plate of burner case 21 is smaller than the total sum of the total of the opening areas of the plurality of opening portions 22*aa*, 20*ab* provided in the wall surface of partition plate 20 and the total of the opening areas of the plurality of through holes 20*b* provided in the bottom surface of partition plate 20. According to such a construction, fluctuation in pressure in burner case 21 can be suppressed by providing an air flow resistance on the upstream side of burner 2. Therefore, a water heater of an exhaust suction type in which occurrence of oscillating combustion of the burner can more reliably be suppressed can be provided. Since fluctuation in pressure in burner case 21 freely takes place when there is no air flow resistance on the upstream side of burner 2 (relation as above between the opening area of air supply opening 25 and the opening areas of opening portions 20*aa* and 20*ab* and through holes 22*b* in partition plate 20 is not satisfied), an effect to suppress fluctuation in pressure is not obtained.

In the water heater in the present embodiment, air supply opening 25 is constituted of two separate air supply opening portions 26 and 27. Thus, in an environment where fluffy dust or sandy dust is present, dust suctioned into burner 2 is distributed as compared with a case that a single air supply opening portion is provided, and hence local clogging in a combustion tube located directly above the air supply opening portion can be suppressed.

In the water heater in the present embodiment, air supply opening portions 26 and 27 are arranged at positions other than a portion directly under unit region 28*a* including two combustion tubes 22 which is always combusted in a state of combustion of burner 2, of the plurality of unit regions 28*a*, 28*b*, and 28*c* constituting combustion region 28. Thus, an air flow resistance against a flow of air supplied into the always combusted unit region can be higher and fluctuation in pressure in the burner case can more efficiently be suppressed. In addition, since clogging by dust of a combustion tube located in the most important unit region always combusted in a combustion state can be suppressed, the combustion state in the combustion region can be stabilized.

In the water heater in the present embodiment, protruding portions 26*a*, 26*b*, 27*a*, and 27*b* protruding outward are provided in a part of the periphery of air supply opening 25 (air supply opening portions 26 and 27) in the bottom plate of burner case 21 and no protruding portion is provided in other portions of the periphery of air supply opening 25. Thus, even though a piece of paper which is larger than the opening area of air supply opening 25 may stick to air supply opening 25, a path for air between outside air and gas introduction chamber 201 can be ensured in a portion where no protruding portion is provided and the air supply opening can be prevented from being closed.

In the water heater in the present embodiment, since air supply opening portions 26 and 27 are in the rectangular shape, protruding portions 26*a*, 26*b*, 27*a*, and 27*b* can readily be formed by folding back a part of burner case 21 which has been worked in advance outward (burring process) in a portion corresponding to at least one side of the rectangular shape.

In the water heater in the present embodiment, lower NOx and stabilization of combustion flame can be achieved by employing a burner of a rich and lean combustion type.

Second Embodiment

A water heater in the present embodiment is different from that in the first embodiment in shape of protruding portions 27*a* and 27*b* provided around air supply opening 25 (air supply opening portions 26 and 27) of burner case 21. Since the present embodiment is otherwise the same as the first embodiment, redundant description will not be provided.

Figure 9:
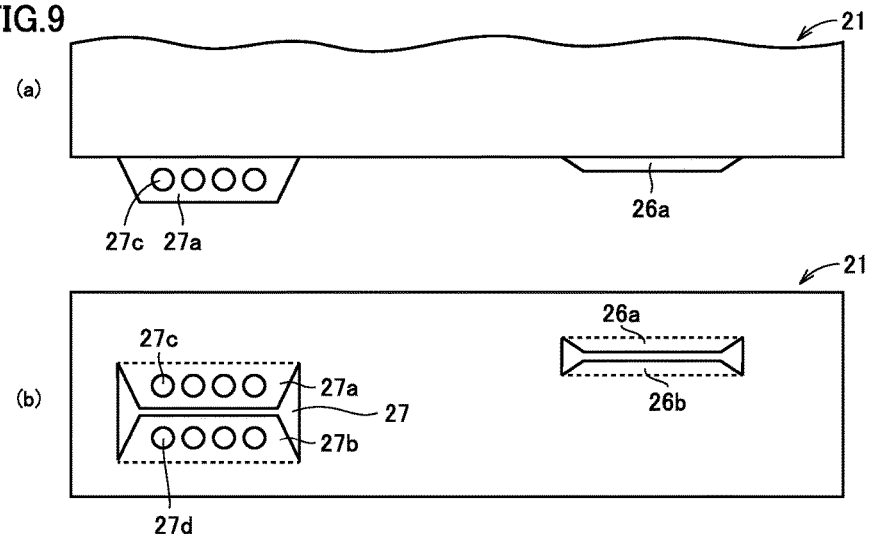
FIG. 9 schematically shows a modification of a protruding portion around an air supply opening of the burner case in the water heater in the first embodiment in (a) a side view and (b) a bottom view of a state before the protruding portion is bent.
Figure 10:
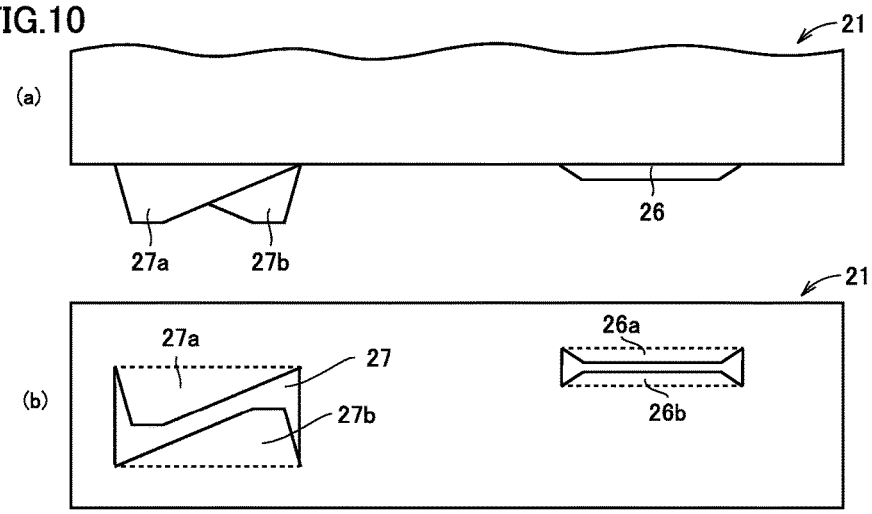
FIG. 10 schematically shows another modification of the protruding portion around the air supply opening of the burner case in the water heater in the first embodiment in (a) a side view and (b) a bottom view of the state before the protruding portion is bent.

Referring to FIG. 9, in the present embodiment, protruding portions 27*a* and 27*b* have hole portions 27*c* and 27*d*. FIGS. 9 and 10 show (a) a side view and (b) a bottom view of a state before the protruding portion is bent.

FIG. 10 shows another modification of the protruding portion in the present embodiment. Referring to FIG. 10, protruding portions 27*a* and 27*b* have such a trapezoidal shape that a base distal to burner case 21 is shorter than a base in contact with burner case 21. Positions of the bases of respective protruding portions 27*a* and 27*b* which are distal to burner case 21 are arranged not to be superimposed on each other in a side view as shown in FIG. 10 (*a*). Thus, even when a piece of paper larger than an opening area of air supply opening portion 27 sticks to air supply opening portion 27, a path for air between outside air and gas introduction chamber 201 can more reliably be ensured in a leg portion of the trapezoid of each of protruding portions 27*a* and 27*b*.

When air supply opening portion 27 provided in the bottom plate of burner case 21 is equal in size, as shown in FIG. 10 (*b*), trapezoidal protruding portions 27*a* and 27*b* of which positions of short bases are displaced from each other are folded back outward along a dotted line, so that a height of tip ends of protruding portions 27*a* and 27*b* (a distance from burner case 21) can be greater than in a case of folding of protruding portions 27*a* and 27*b* in a shape as shown in FIG. 9 (*b*) outward along a dotted line. Therefore, a path for air between outside air and gas introduction chamber 201 can more reliably be ensured. In a case that air supply opening 27 has the same opening area, a height of the tip end of the protruding portion can be greatest when the protruding portion is provided by folding back the bottom surface of burner case 21 only at one side of the rectangular shape of air supply opening portion 27, and such a form can also be adopted.

Figure 11:
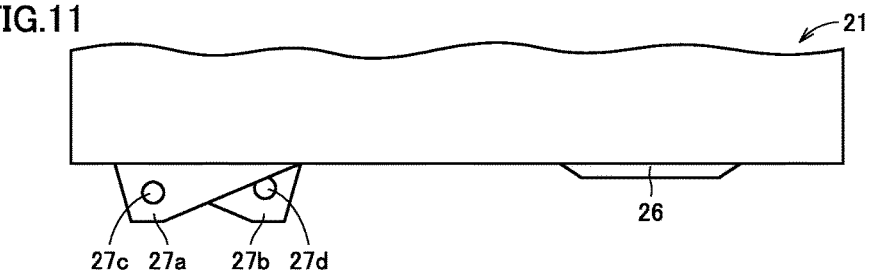
FIG. 11 is a side view schematically showing yet another modification of the protruding portion around the air supply opening of the burner case in the water heater in the first embodiment.

FIG. 11 shows yet another modification of the protruding portion in the present embodiment. Protruding portions 27*a* and 27*b* shown in FIG. 11 are the same in geometry as those in FIG. 10 and further have hole portions 27*c* and 27*d*.

Air supply opening portion 26 is smaller in opening area than air supply opening portion 27 in the present embodiment. Therefore, even when air supply opening portion 26 alone is clogged, significant deterioration in combustion does not take place, and hence a shape of protruding portions 26*a* and 26*b* is similar to that in the first embodiment. Protruding portions 26*a* and 26*b*, however, may be deformed similarly to protruding portions 27*a* and 27*b* in the present embodiment.

In the water heater in the present embodiment described above, in a case that protruding portions 27*a* and 27*b* have hole portions 27*c* and 27*d*, even when a piece of paper greater than an opening area of air supply opening portion 27 may stick to air supply opening portion 27, a path for air between outside air and gas introduction chamber 201 can be ensured through hole portions 27*c* and 27*d* and hence clogging of the air supply opening can more reliably be suppressed.

Although embodiments of the present invention have been described, it should be understood that the embodiments disclosed herein are illustrative and non-restrictive in every respect. The scope of the present invention is defined by the terms of the claims, and is intended to include any modifications within the scope and meaning equivalent to the terms of the claims.

What is claimed is:

1. A water heater, comprising:

a burner of a premixed type which generates combustion gas by burning an air fuel mixture in a combustion region;

a heat exchanger heating water which flows through an inside of the water heater, through heat exchange with combustion gas generated in the burner; and a fan suctioning combustion gas which has passed through the heat exchanger and exhausting combustion gas to an outside of the water heater, the burner including a burner case partitioned into a combustion chamber and a gas introduction chamber by a partition plate and a plurality of combustion tubes arranged in the combustion chamber, the burner case being provided with a permanently fixed air supply opening in a wall of the burner case, wherein the permanently fixed air supply opening is for supplying air into the gas introduction chamber, the partition plate having a plurality of opening portions communicating with an inside of the combustion tubes and a plurality of through holes communicating with an outside of the combustion tubes arranged within the combustion chamber, wherein the permanently fixed air supply opening is constructed to have an opening area smaller than a total sum of a total of opening areas of the plurality of opening portions and a total of opening areas of the plurality of through holes, and wherein the opening area of the permanently fixed air supply opening is measured at a point where the permanently fixed air supply opening intersects with the wall of the burner case.

2. The water heater according to claim 1, wherein the permanently fixed air supply opening has a plurality of permanently fixed air supply opening portions.

3. The water heater according to claim 1, wherein the combustion region is constituted of a plurality of unit regions which can independently be controlled such that an amount of generation of combustion gas can be varied in accordance with requested hot water supply capability, and the permanently fixed air supply opening is arranged at a position other than directly under at least one of the plurality of unit regions which is configured so that the air fuel mixture is always combusted during a combustion state of the burner.

4. The water heater according to claim 2, wherein the combustion region is constituted of a plurality of unit regions which can independently be controlled such that an amount of generation of combustion gas can be varied in accordance with requested hot water supply capability, and each of the plurality of permanently fixed air supply opening portions is arranged at a position other than directly under at least one of the plurality of unit regions which is configured so that the air fuel mixture is always combusted during a combustion state of the burner.

5. The water heater according to claim 1, wherein a protruding portion protruding outward from the burner case is provided in a part of a periphery of the permanently fixed air supply opening of the burner case and no protruding portion is provided in an other part of the periphery of the permanently fixed air supply opening.

6. The water heater according to claim 2, wherein a protruding portion protruding outward from the burner case is provided in a part of a periphery of each of the plurality of permanently fixed air supply opening portions of the burner case and no protruding portion is provided in an other part of the periphery of each of the plurality of permanently fixed air supply opening portions.

7. The water heater according to claim 3, wherein a protruding portion protruding outward from the burner case is provided in a part of a periphery of the permanently fixed air supply opening of the burner case and no protruding portion is provided in an other part of the periphery of the permanently fixed air supply opening.

8. The water heater according to claim 4, wherein a protruding portion protruding outward from the burner case is provided in a part of a periphery of each of the plurality of permanently fixed air supply opening portions of the burner case and no protruding portion is provided in an other part of the periphery of each of the plurality of permanently fixed air supply opening portions.

9. The water heater according to claim 5, wherein the permanently fixed air supply opening is in a rectangular shape and the protruding portion is formed by folding back a part of the burner case outward from the burner case in a portion corresponding to at least one side of the rectangular shape.

10. The water heater according to claim 6, wherein each of the plurality of permanently fixed air supply opening portions is in a rectangular shape and the protruding portion of each permanently fixed air supply opening is formed by folding back a part of the burner case outward from the burner case in a portion corresponding to at least one side of the respective rectangular shape.

11. The water heater according to claim 7, wherein the permanently fixed air supply opening is in a rectangular shape and the protruding portion is formed by folding back a part of the burner case outward from the burner case in a portion corresponding to at least one side of the rectangular shape.

12. The water heater according to claim 8, wherein each of the plurality of permanently fixed air supply opening portions is in a rectangular shape and the protruding portion of each permanently fixed air supply opening is formed by folding back a part of the burner case outward from the burner case in a portion corresponding to at least one side of the respective rectangular shape.

13. The water heater according to claim 5, wherein the protruding portion has a hole portion.

14. The water heater according to claim 1, wherein the burner is of a rich and lean combustion type.

* * * * *